US007221329B2

(12) United States Patent
Cornwell

(10) Patent No.: US 7,221,329 B2
(45) Date of Patent: May 22, 2007

(54) ENHANCED BEAM ANTENNA

(76) Inventor: James Henly Cornwell, 3720 S. Susan St., Santa Anna, CA (US) 92704

( * ) Notice: Subject to any disclaimer, the term of this patent is extended or adjusted under 35 U.S.C. 154(b) by 29 days.

(21) Appl. No.: 11/016,870

(22) Filed: Dec. 21, 2004

(65) Prior Publication Data

US 2005/0200982 A1 Sep. 15, 2005

Related U.S. Application Data

(60) Provisional application No. 60/532,176, filed on Dec. 24, 2003.

(51) Int. Cl.
*H01Q 15/14* (2006.01)

(52) U.S. Cl. ..... 343/912; 343/872; 343/873

(58) Field of Classification Search ..... 343/872, 343/873, 907, 912
See application file for complete search history.

(56) References Cited

U.S. PATENT DOCUMENTS 2,826,513 A * 3/1958 Blanchard ..... 427/476
3,851,200 A 11/1974 Thomasson
4,763,133 A * 8/1988 Takemura et al. ..... 343/912
5,334,476 A 8/1994 Yagi et al.
5,939,182 A 8/1999 Huang et al.
6,195,156 B1 2/2001 Miyamoto et al.
6,568,835 B2 * 5/2003 Wijbenga et al. ..... 362/349
2002/0196628 A1 * 12/2002 Yoshida et al. ..... 362/296

* cited by examiner

*Primary Examiner*—Tan Ho
*Assistant Examiner*—Dieu Hien Duong
(74) *Attorney, Agent, or Firm*—Millen, White, Zelano & Branigan, P.C.

(57) ABSTRACT

A reflector includes a conductive surface and a surface coating. The surface coating includes a binder and metal oxide grains embedded in the binder. The metal oxide grains include aluminum oxide that constitute up to 60% of the metal oxide by weight. A method of making a reflector includes forming a slurry, applying an electric field between a spray gun nozzle and the reflector, and spraying the slurry through the spray gun nozzle onto the reflector. The slurry contains metal oxide grains suspended in a binder.

13 Claims, 3 Drawing Sheets

ENHANCED BEAM ANTENNA

The priority benefit of the filing date of U.S. provisional application No. 60/532,176 filed Dec. 24, 2003, incorporated herein by reference, is hereby claimed.

BACKGROUND OF THE INVENTION

1. Field of the Invention

The present invention relates to high power radiation beams and methods of producing such beams. In particular, the invention relates to a reflector capable of enhancing the power of the radiation beam reflected off the reflector.

2. Description of Related Art

Parabolic reflector antennas are known. There is an increasing interest in this technical art to producing high power radiation beams at a distance that are sufficiently high power to first jam and second burn out sensitive radiation receiver electronics. By coupling a parabolic reflector antenna with a high power microwave source, a high power radiation beam at microwave frequencies is produced that can jam and even burn out sensitive receiver electronics at a particular distance from the reflector.

However, increases in the distance from the reflector at which receiver electronics can be put at risk comes only with the increased power of the microwave source, or in some cases, an increased size of the reflector to produce a higher gain reflector antenna that is better focused at the distance.

An improvement in the art would be a way of increasing the effective radiated power on the sensitive receiver electronics at the distance without the need for either an increased power of the microwave source, or an increased size of the reflector.

SUMMARY OF THE INVENTION

In an embodiment of a reflector according to the invention, the reflector includes a conductive surface and a surface coating. The surface coating includes a binder and metal oxide grains embedded in the binder. The metal oxide grains include aluminum oxide that constitute up to 60% of the metal oxide by weight.

In an embodiment of a method of making a reflector according to another embodiment of the invention, the method includes forming a slurry, applying an electric field between a spray gun nozzle and the reflector, and spraying the slurry through the spray gun nozzle onto the reflector. The slurry contains metal oxide grains suspended in a binder.

BRIEF DESCRIPTION OF DRAWINGS

The invention will be described in detail in the following description of preferred embodiments with reference to the following figures.

DETAILED DESCRIPTION OF PREFERRED EMBODIMENTS

Figure 1:
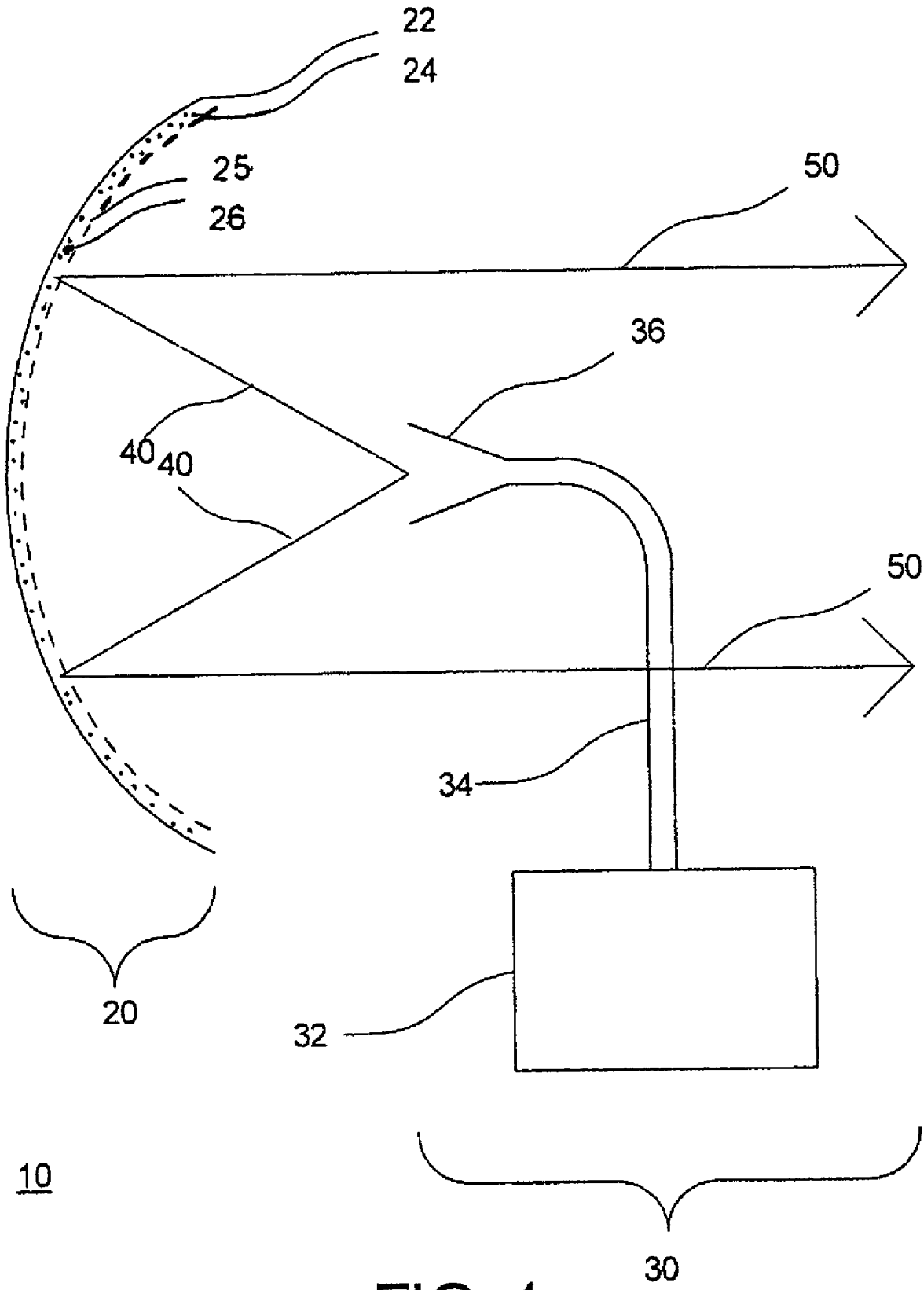
FIG. 1 is a schematic diagram of a beam antenna according to an embodiment of the invention.
Figure 3:
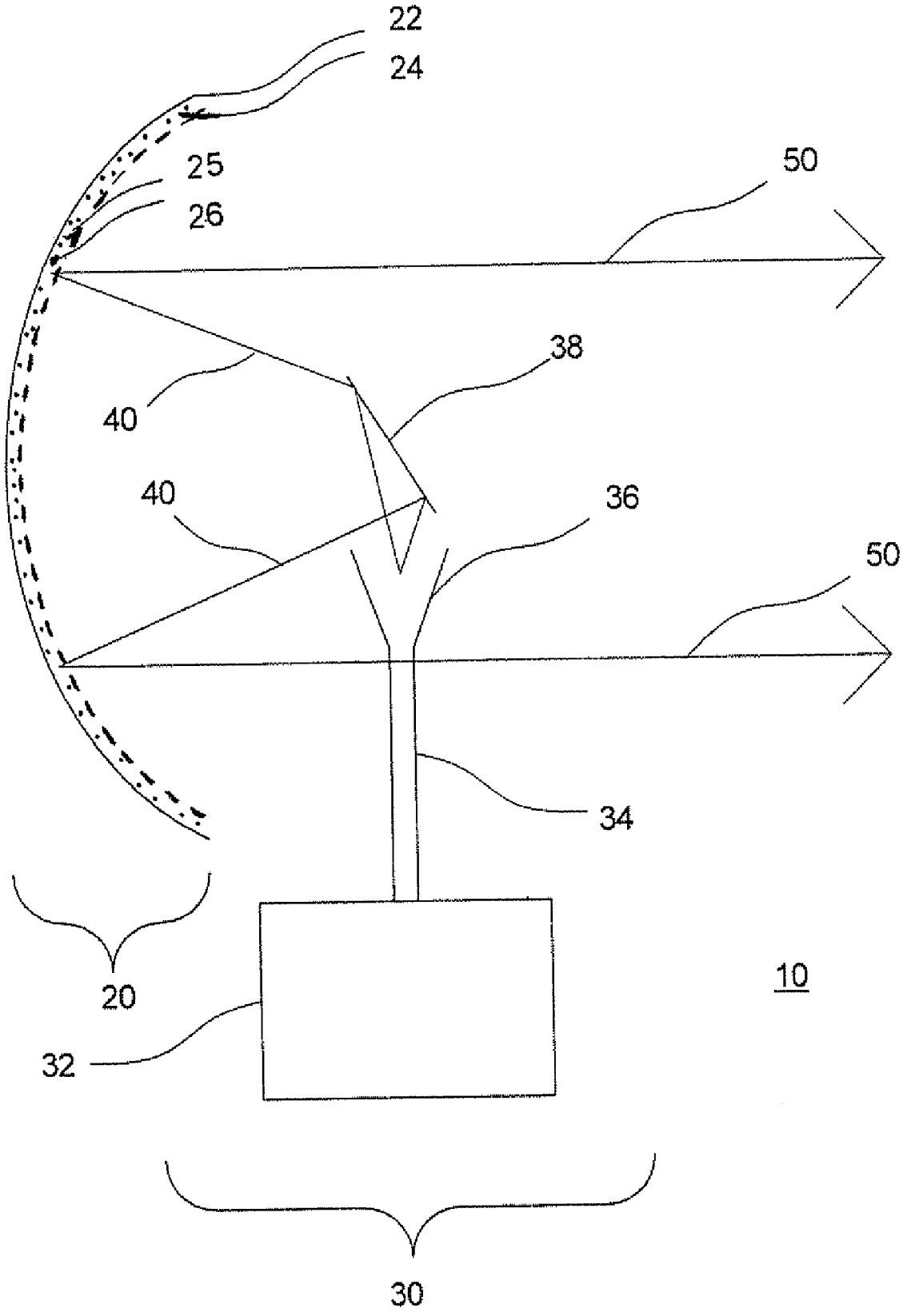
FIG. 3 is a schematic diagram of an alternative beam antenna according to an embodiment of the invention.

In FIG. 1, a system 10 includes reflector section 20 and a transmitter section 30. The reflector section includes a reflector 22 that cooperates with a feed antenna 36 (for example a horn antenna) of the transmitter section to produce planar wave front radiation 50. In one embodiment, feed antenna 36 launches expanding spherical wave front radiation 40 to reflect off reflector 22 to produce planar wave front radiation 50, and in this case, reflector 22 is a parabolic reflector to transform expanding spherical waves into planar waves. Transmitter section 30 also includes transmitter 32 and feed 34 that is coupled to the feed antenna 36. Alternative designs of transmitter section 30 (see FIG. 3) may use a splash plate 38 and then the transmitter, feed and feed antenna are relocated to irradiate the splash plate in a way that produces the expanding spherical wave front radiation 40. The only requirement is that the planar wave front radiation 50 be produced. The splash plate 38 may be flat forming what is called a folded optics arrangement. Alternatively, the splash plate may have a curved surface that cooperates with the curved surface of reflector 22 in an optical arrangement that produces the planar wave front radiation 50.

In the present embodiment, the reflector 22 is coated with a surface coating 24. The surface coating 24 includes a binder 25 and metal oxide grains 26 embedded in the binder. The metal oxide grains include sufficient grains of aluminum oxide to constitute up to 60% of the metal oxide by weight. In a variant of this embodiment, the metal oxide grains further include manganese dioxide grains that constitute up to 31% of the metal oxide by weight, and the remaining metal oxide grains include copper oxide.

Figure 2:
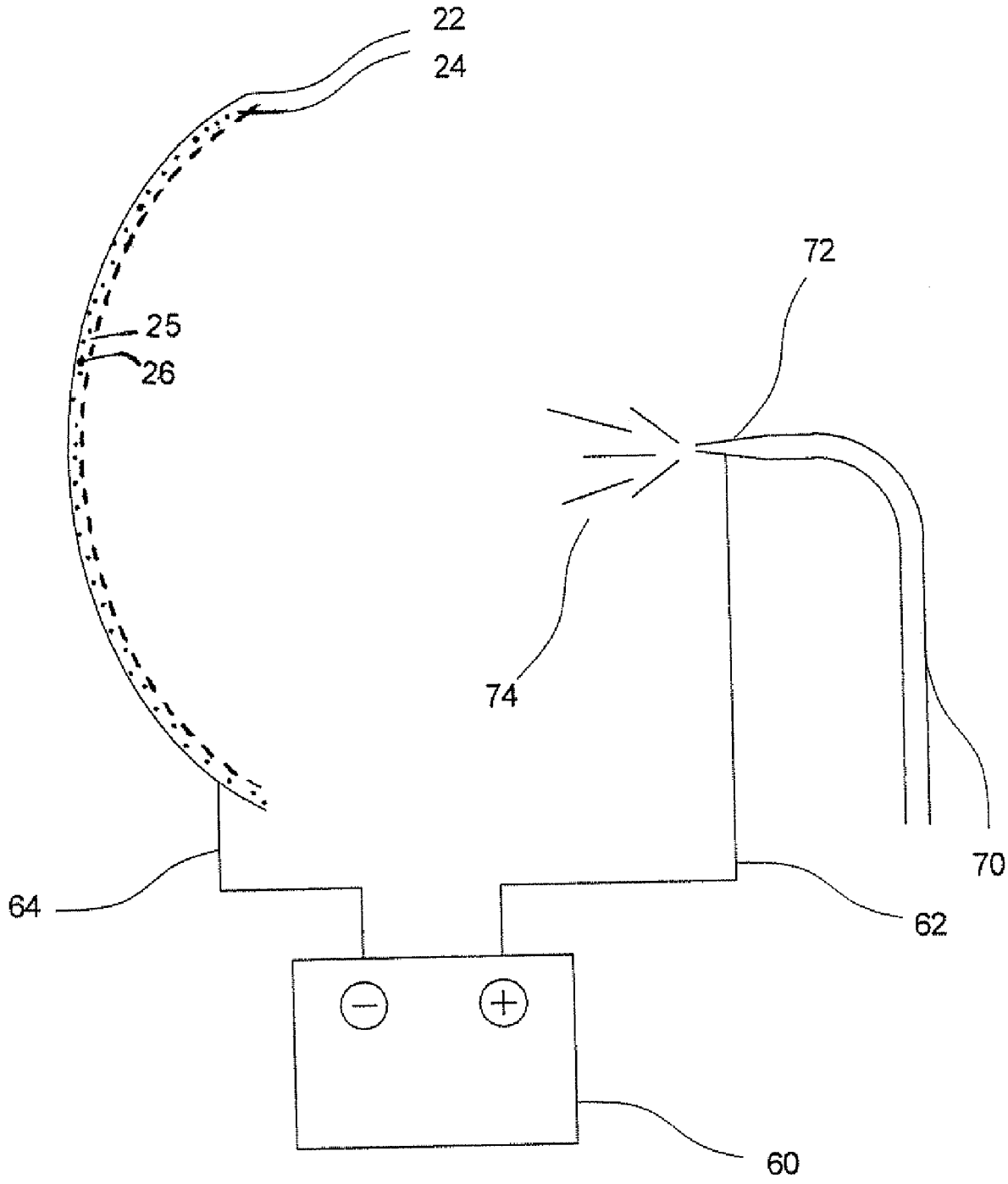
FIG. 2 is a schematic diagram of a setup for an embodiment of a process of producing a beam antenna according to an embodiment of the invention.

In FIG. 2, a setup is shown for spraying the surface coating 24 onto reflector 22. A slurry of binder and metal oxide grains is pumped into tubing 70 and through conductive nozzle 72 to produce spray 74. This could be an ordinary paint spray setup. However, a power supply 60 provides a high voltage with a positive lead 62 connected to conductive nozzle 72 and a negative lead connected to reflector 64. As the slurry passes through the nozzle 72 the metal oxide grains are electrified and take on an electric dipole that becomes oriented orthogonal to the local surface of the reflector when the spray lights on the reflector 22. The binder might be, for example clear coat enamel, or it might be lacquers or other binders. The metal oxide grains are ground to be small. For example, tests have been made with a grain size of 5 microns. However, grain sizes as small as 2 microns up to 10 microns might be used. In a prototype, a 3 meter diameter parabolic reflector that was measured to have a 36 dB antenna gain actually produced a 42 dB antenna gain with the addition of the electric dipole impregnated surface coating 24. The surface coating in this prototype used clear coat enamel for the binder 25, and the metal oxide 26 was composed of aluminum oxide, 60% by weight, manganese oxide, 31% by weight, and copper oxide, 9% by weight. The reflector 22 was charged to a negative 18,000 volts relative to earth ground, and the conductive nozzle 72 was charged to a positive 18,000 volts relative to earth ground. The spray of the surface coating 24 was at a rate that required only about 15 minutes to produce four very uniform coats on the reflector surface, using fast drying binders, each coat being less than 0.002 inches thick to avoid orange peal and surface cracking. Including setup and take down, the surface coating, as a whole process required one to three hours, about 2 hours in this instance, to cover the 3 meter reflector. The setup and take down required time to charge, and then safely discharge the operator from an insulated work platform since the operation was holding the conductive nozzle that was positively charged by 18,000 volts with respect to earth ground.

The electrostatic spray aligns the electric dipoles of the metal oxide grains so that the metal oxide grains are characterized by an electric dipole oriented substantially orthogonal to the conductive surface. By embedding the metal oxide grains in the binder while an electric field is applied between the conductive surface and the nozzle 72, the dipoles become oriented orthogonal to the local surface of the reflector 22.

Practical antenna reflectors made in the real world (as opposed to theoretical calculations) tend to have multiple imperfections such as micro-dents, scratches, abrasions etc. that tend to limit their performance to less than what could be calculated from theory. Some investigators have gone through extensive efforts to provide a micro-polished surface on a reflector to increase the reflector antenna gain. However, the surface coating described herein provides the same or better improvement in performance in a more easily performed fabrication process.

Having described preferred embodiments of a novel enhanced beam antenna (which are intended to be illustrative and not limiting), it is noted that modifications and variations can be made by persons skilled in the art in light of the above teachings. It is therefore to be understood that changes may be made in the particular embodiments of the invention disclosed which are within the scope of the invention as defined by the appended claims.

Having thus described the invention with the details and particularity required by the patent laws, what is claimed and desired protected by Letters Patent is set forth in the appended claims.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and, all parts and percentages are by weight, unless otherwise indicated.

The entire disclosure of all applications, patents and publications, cited herein and of corresponding U.S. Provisional Application Ser. No. 60/532,176, filed Dec. 24, 2004, is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A reflector comprising a conductive surface and a surface coating, wherein:

the surface coating includes a binder and metal oxide grains embedded in the binder; and the metal oxide grains include aluminum oxide that constitute up to 60% of the metal oxide by weight and manganese dioxide that constitute up to 31% of the metal oxide by weight; and the remaining metal oxide grains include copper oxide.

2. A reflector according to claim 1, wherein the metal oxide grains are embedded in the binder while an electric field is applied between the conductive surface and a spray source of the binder.

3. A reflector according to claim 2, wherein the electric field is developed from a potential difference between the conductive surface and the spray source of at least 30,000 volts.

4. A reflector comprising a conductive surface and a surface coating, wherein:

the surface coating includes a binder and metal oxide grains embedded in the binder; and the metal oxide grains include aluminum oxide that constitute up to 60% of the metal oxide by weight and the metal oxide grains are embedded in the binder while an electric field is applied between the conductive surface and a spray source of the binder.

5. A reflector according to claim 4, wherein the electric field is developed from a potential difference between the conductive surface and the spray source of at least 30,000 volts.

6. A reflector according to claim 4, wherein the surface coating is formed by:

forming a slurry containing metal oxide grains suspended in a binder;

applying an electric field between a spray gun nozzle and the reflector; and spraying the slurry through the spray gun nozzle onto the reflector.

7. A reflector according to claim 6, wherein the surface coating is further formed by:

applying a first electric voltage to the spray gun nozzle; and applying a second electric voltage to the reflector, wherein a difference between the first and second voltages is greater than 30,000 volts.

8. A method of making a reflector comprising:

forming a slurry containing metal oxide grains suspended in a binder;

applying an electric field between a spray gun nozzle and the reflector; and spraying the slurry through the spray gun nozzle onto the reflector.

9. A method according to claim 8, wherein the applying an electric field includes:

applying a first electric voltage to the spray gun nozzle; and applying a second electric voltage to the reflector, wherein a difference between the first and second voltages is greater than 30,000 volts.

10. A method according to claim 8, wherein the slurry on the reflector forms a surface coating that includes the binder and the metal oxide grains embedded in the binder.

11. A method according to claim 10, wherein:

the metal oxide grains include manganese dioxide that constitute up to 31% of the metal oxide by weight; and the remaining metal oxide grains include copper oxide.

12. A method according to claim 11, wherein the metal oxide grains are characterized by an electric dipole oriented substantially orthogonal to the conductive surface.

13. A method according to claim 10, wherein the metal oxide grains are characterized by an electric dipole oriented substantially orthogonal to the conductive surface.

* * * * *